US009725988B2

(12) United States Patent
Gano

(10) Patent No.: US 9,725,988 B2
(45) Date of Patent: Aug. 8, 2017

(54) EXTERIOR DRAIN TUBE FOR WELL SCREEN ASSEMBLIES

(71) Applicant: Halliburton Energy Services, Inc., Houston, TX (US)

(72) Inventor: John C. Gano, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/346,891

(22) PCT Filed: Mar. 26, 2013

(86) PCT No.: PCT/US2013/033896
§ 371 (c)(1),
(2) Date: Mar. 24, 2014

(87) PCT Pub. No.: WO2014/158141
PCT Pub. Date: Oct. 2, 2014

(65) Prior Publication Data

US 2016/0003014 A1 Jan. 7, 2016

(51) Int. Cl.
*E21B 43/04* (2006.01)
*E21B 43/08* (2006.01)

(52) U.S. Cl.
CPC ..... *E21B 43/045* (2013.01); *E21B 43/04* (2013.01); *E21B 43/08* (2013.01)

(58) Field of Classification Search
CPC ..... E21B 43/04; E21B 43/045; E21B 43/08–43/088
USPC ..... 166/278, 227–236
See application file for complete search history.

(56) References Cited

U.S. PATENT DOCUMENTS 2,323,992 A * 7/1943 Hardeman ..... E21B 43/10 166/205
5,588,487 A * 12/1996 Bryant ..... E21B 33/126 166/227
5,868,200 A * 2/1999 Bryant ..... E21B 43/08 166/242.3
5,890,533 A 4/1999 Jones
6,520,254 B2 2/2003 Hurst et al.
6,752,207 B2 6/2004 Danos et al.
7,048,061 B2 5/2006 Bode et al.
(Continued)

OTHER PUBLICATIONS

PCT International Search Report and Written Opinion of the International Searching Authority, PCT/US2013/033896, Oct. 25, 2013, 10 pages.

(Continued)

*Primary Examiner* — George Gray
(74) *Attorney, Agent, or Firm* — Scott Richardson; Parker Justiss, P.C.

(57) ABSTRACT

A well screen system for use in a wellbore has an elongate base pipe and a screen encircling the base pipe. The screen is configured to filter against passage of particulate into a center bore of the base pipe. The base pipe has a fluid impermeable portion exterior to the screen. A cover sleeve resides over the fluid impermeable portion of the base pipe. A drain tube with a fluid permeable sidewall resides exterior to the base pipe and screen, affixed to the cover sleeve. The drain tube is adapted to communicate fluid from the wellbore around the fluid impermeable portion to the screen.

18 Claims, 4 Drawing Sheets

(56) References Cited

U.S. PATENT DOCUMENTS

| | | | | |
|---|---|---|---|---|
| 7,789,152 | B2 * | 9/2010 | Langeslag | E21B 34/063 166/205 |
| 7,828,056 | B2 | 11/2010 | Dybevik et al. | |
| 2002/0092649 | A1 * | 7/2002 | Bixenman | E21B 43/04 166/278 |
| 2008/0066900 | A1 | 3/2008 | Saebi et al. | |
| 2009/0008092 | A1 | 1/2009 | Haeberle et al. | |
| 2009/0159270 | A1 | 6/2009 | Setterberg, Jr. et al. | |
| 2010/0051262 | A1 * | 3/2010 | Dusterhoft | E21B 47/01 166/236 |
| 2010/0059232 | A1 | 3/2010 | Langlais et al. | |
| 2010/0236779 | A1 | 9/2010 | Nutley et al. | |
| 2011/0011585 | A1 * | 1/2011 | O'Malley | E21B 43/08 166/278 |
| 2011/0297376 | A1 | 12/2011 | Holderman et al. | |
| 2012/0103608 | A1 | 5/2012 | van Petegem et al. | |

OTHER PUBLICATIONS

PCT International Preliminary Report on Patentability, PCT/US2013/033896, Oct. 8, 2015, 7 pages.

* cited by examiner

EXTERIOR DRAIN TUBE FOR WELL SCREEN ASSEMBLIES

This application is a 371 national phase of and claims the benefit of priority to PCT Application Serial No. PCT/US2013/033896, filed on Mar. 26, 2013 and entitled "Exterior Drain Tube for Well Screen Assemblies", the contents of which are hereby incorporated by reference.

BACKGROUND

Wells often use screen systems in their production string to filter solid particles (e.g., sand) greater than a permitted size. Some wells are gravel packed by placing gravel in the annulus around the well screen system. For example, in an open-hole completion, gravel is typically placed between the wall of the wellbore and the production string. Alternatively, in a cased-hole completion, gravel is placed between a perforated casing string and the production string. In both types of completions, formation fluids flow from the subterranean formation into the production string through the gravel pack and well screen system.

The gravel is carried into the well with a carrier liquid in a slurry. As the gravel is placed, the liquid carrier is drained out through the well screen system to the surface.

DESCRIPTION OF DRAWINGS

Like reference symbols in the various drawings indicate like elements.

DETAILED DESCRIPTION

In some implementations, in completing an open hole section of a well, a production string having one or more well screen assemblies is run into the open hole section of the well bore. The screen assemblies are axially spaced along the length of the string. Each screen assembly has a filtration screen that encircles a base pipe. The base pipe has portion with one or more apertures that allow communication of fluids through the screen, and a portion that is not apertured (i.e., fluid impermeable) outside of the screen. An apertured shroud is positioned around the exterior of the filtration screen. Shunt tubes run axially through the screen assembly from one end to the other, and are radially between the apertured shroud and base pipe. The ends of the filtration screen are capped with annular end rings. The screen assemblies thread end to end, and jumper tubes connect between the end rings to connect the shunt tubes of one screen assembly to the next. A cover sleeve is positioned around the jumper tubes between the screen assemblies. With the production string in place, the annulus around the well screen assemblies is "gravel packed." In gravel packing, a particulate (e.g., gravel) laden slurry is pumped into the wellbore exterior the string. The particulate is deposited in the annulus around the screen assemblies, and the carrier liquid in the slurry is drained into the center bore of the string through the well screen assemblies and pumped backed to the surface.

Sometimes, especially when gravel packing a long well, variations in drainage of the carrier liquid from gravel slurry can cause inconsistencies, such as voids, to form in the gravel packing The problem is particularly acute in solid, fluid impermeable portions of the string, for example at the ends of each screen assembly. A fluid permeable conduit, carried on the screen assemblies over the fluid impermeable portions (e.g., carried on the cover sleeve), can be implemented for communicating fluid from this region to the fluid permeable portions of the screen assemblies. The conduit allows the carrier liquid to more easily escape to the fluid permeable portions of the screen assemblies and be drained to the surface. The conduits may be in the form of drain tubes in locations where fluid draining is limited (e.g., fluid impermeable section, such as near ends of screen assemblies and/or elsewhere). The drain tubes can therefore reduce the possibility of voids and/or other inconsistences in the gravel pack.

Figure 1:
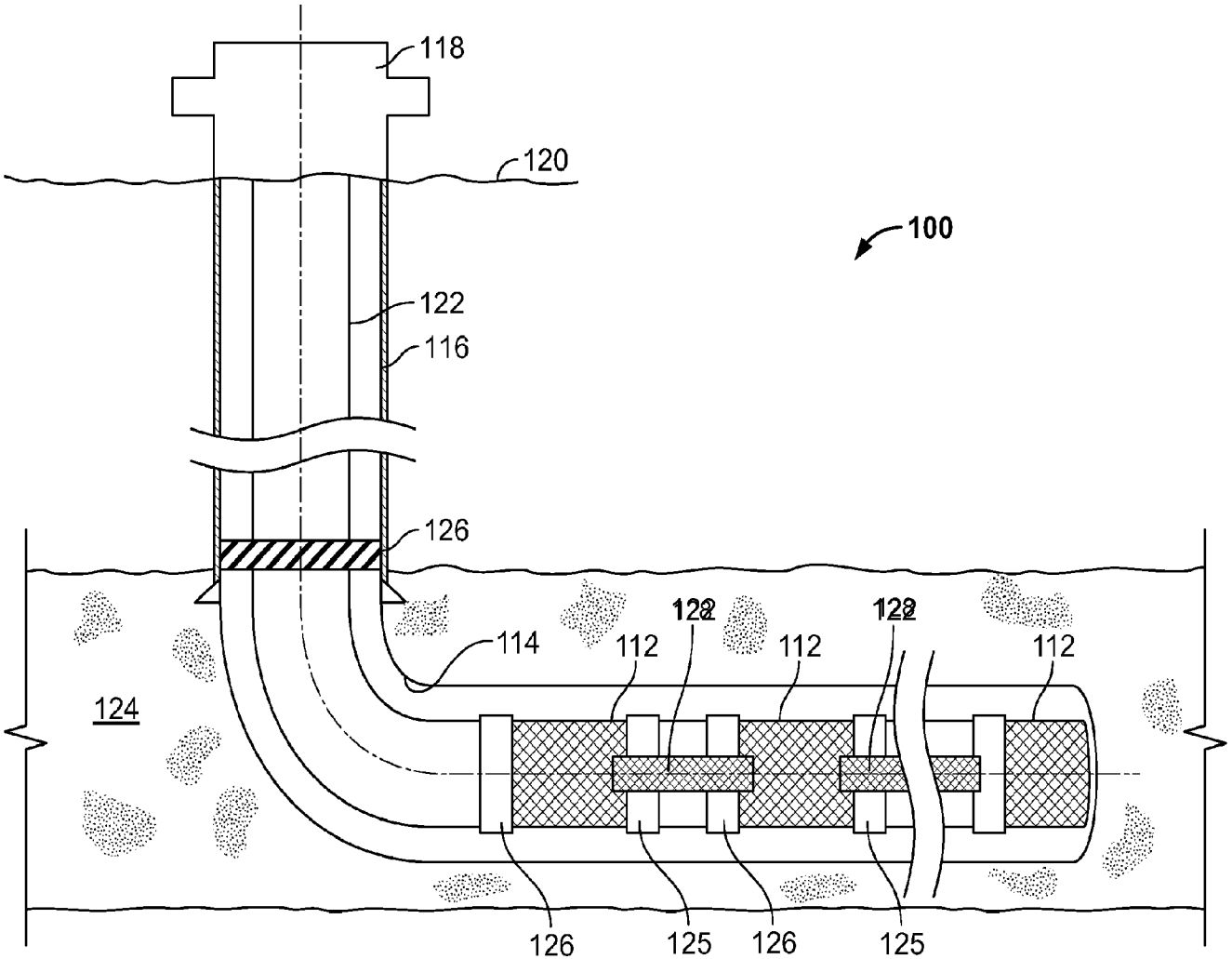
FIG. 1 is a schematic side view of a well system.

FIG. 1 is a schematic side view of a well system 100 in accordance with the present disclosure. The well system 100 is shown as being a horizontal well, having a wellbore 114 that extends substantially vertically from a wellhead 18 at the surface, then deviates to horizontal or substantially horizontal in the subterranean zone of interest 124. A casing 116 is cemented in the vertical portion of the wellbore and coupled to the wellhead 118 at the surface 120. The remainder of the wellbore 114 is completed open hole (i.e., without casing). A production string 122 extends from wellhead 118, through the wellbore 114 and into the subterranean zone of interest 124.

A production packer 126 seals the annulus between the production string 122 and the casing 116. Additional packers 126 can be provided between the screen assemblies 112. The production string 122 operates in producing fluids (e.g., oil, gas, and/or other fluids) from the subterranean zone 124 to the surface 120. The production string 122 includes one or more well screen assemblies 112 (three shown). In some instances, the annulus between the production string 122 and the open hole portion of the wellbore 114 may be packed with gravel of a specified size. The well screen assemblies 112 and gravel packing allow communication of fluids between the production string 122 and subterranean zone 124. The gravel packing provides a first stage of filtration against passage of particulate and larger fragments of the formation to the production string 122. The well screen assemblies 112 provide a second stage of filtration, and are configured to filter against passage of particulate of a specified size and larger into the production string 122.

Portions 125 of the well screen assemblies 112 are fluid impermeable and cannot communicate fluid in the wellbore 114 to the center bore of the string 122. One or more conduits, e.g. drain tubes 128, are carried on the outer diameter of the well screen assemblies 112 to collect fluid in the wellbore 114, such as the carrier liquid from the gravel packing slurry, and communicate the fluid from fluid impermeable portions of the well screen assemblies 112 or string 122 through the gravel packing to fluid permeable portions of the well screen assemblies 112. In the context of gravel packing, as noted above, the drain tubes 128 facilitate even draining of the carrier liquid from the gravel slurry; and therefore, more uniform gravel packing Although shown in the context of a horizontal well system 100, the concepts herein can be applied to other well configurations, including vertical well systems consisting of a vertical or substantial vertical wellbore, multi-lateral well systems having multiple wellbores deviating from a common wellbore and/or other well systems. Also, although described in a production context, concepts herein can are applicable in other contexts, including injection (e.g., with the well screen assembly 112 as part of an injection string), well treatment (e.g., with the well screen assembly 112 as part of a treatment string) and/or other applications.

Figure 2:
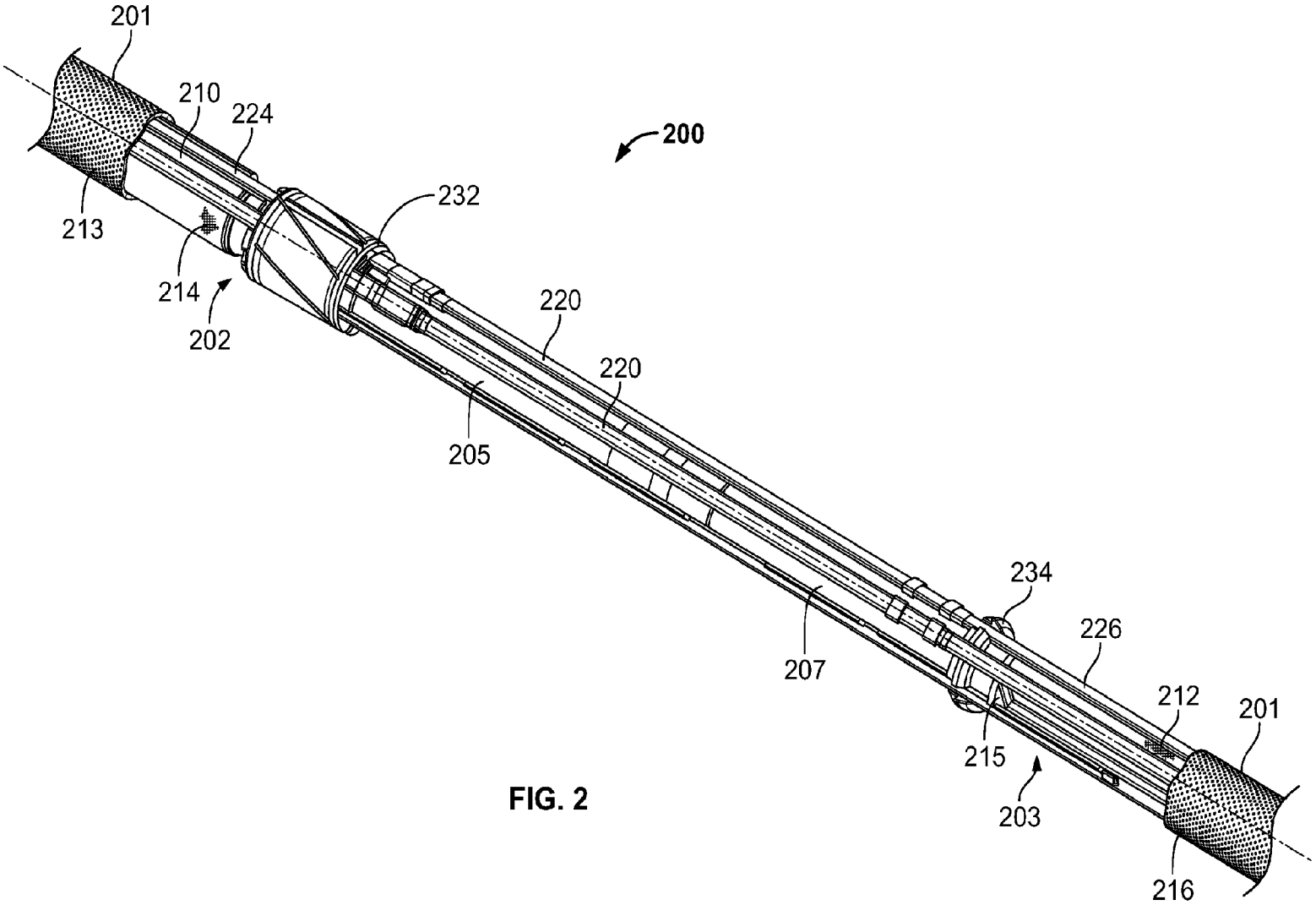
FIG. 2 is a perspective view of part of an example well screen system, omitting the cover sleeve and showing the exterior shrouds in cut-away for convenience of reference.

FIG. 2 illustrates an example 200 of two well screen assemblies coupled together that can be used in the well system of FIG. 1. For convenience of description, the well screen system 200 is illustrated with its inner components exposed (i.e., the exterior shroud 201 is shown in partial break away). The well screen system 200 includes a first well screen assembly 202 and a second well screen assembly 203. The well screen assembly 202 includes a base pipe 205; and the well screen assembly 203 includes a base pipe 207. The base pipes 205, 207 are coupled end to end to each other (e.g., threadingly and/or otherwise). The well screen assembly 202 further includes a fluid permeable screen 210 encircling the base pipe 205. For example, the screen 210 can include one or more layers of sheet mesh or wire wrapped screen (i.e., fluid permeable screen layers 214) with a selected industry rating for filtering particulate over a specified size. Similarly, the screen assembly 203 further includes a screen 215 encircling the base pipe 207, the screen 215 being similar to the screen 210 (with fluid permeable screen layers 212). The screen 210 is sealingly affixed to and spans between an end ring 232 and another end ring (not shown). Likewise screen 215 is sealingly affixed to and spans between an end right 234 and another end ring (not shown). The end rings (including end rings 232, 234) are sealingly affixed to the base pipes 205, 207, so that all fluid that enters the screens 210, 212 is retained between the end rights. The base pipes 205, 207 are apertured beneath the end rings and the end rings adapted to collect flow from the screens 210, 212 or the base pipes 205, 207 are apertured beneath the fluid permeable screens 210, 212. The apertures allow fluid to be communicated between the interior center bore of the base pipes 205, 207 and the exterior of the well screen assemblies 202, 203 through the screens 210, 212. The base pipes 205, 207, however, are fluid impermeable (e.g., solid and not apertured) exterior the screens 210, 212 and end rings, so that no unfiltered fluid is allowed to pass into the center bore of the base pipes 205, 207. In certain instances, one or more of the end rings (shown here as end ring 232) can be integrated with a centralizer.

Figure 3:
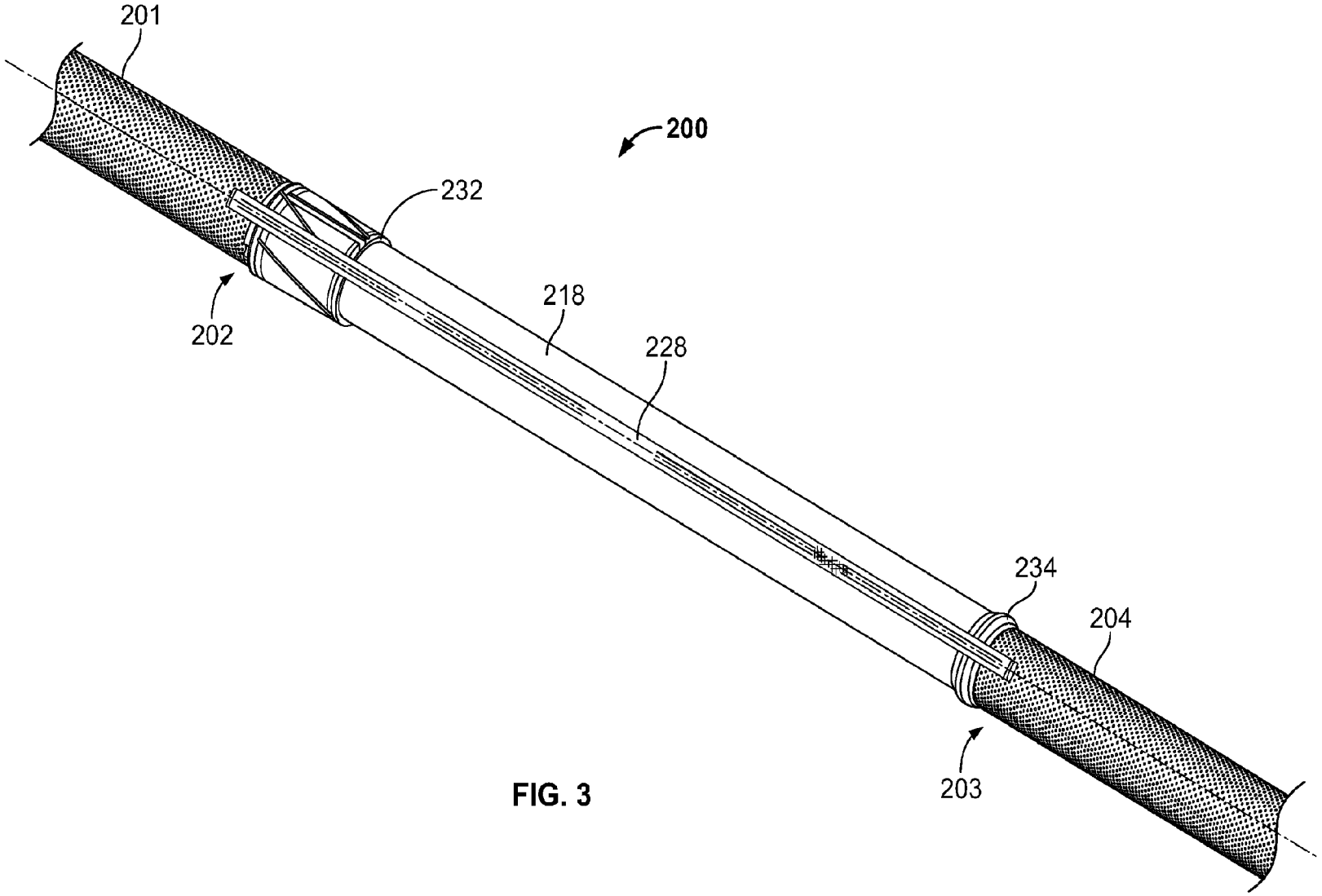
FIG. 3 is a perspective view of the part of the well screen system of FIG. 2, showing the cover sleeve and drain tube.

As illustrated in FIG. 2, each well screen assembly 202, 203 includes one or more shunt tubes (two per well screen assembly are shown) positioned between the screen and the exterior shroud. For example, an elongate shunt tube 224 is arranged axially along and spanning the screen 210 and terminated at end ring 232. The shunt tube 224 extends to another end ring (not shown) at the opposite end of the screen 210, and may have an apertured or otherwise fluid permeable sidewall. Similarly, the well screen assembly 203 includes an elongate shunt tube 226 that is arranged axially along and spanning the screen 210 and terminated at an end ring 234, and may have an apertured or otherwise fluid permeable sidewall. The shunt tube 226 may be substantially similar to the shunt tube 224. The shunt tubes are fluidically coupled by elongate jumper tubes 220 received between the shut tubes 224, 226. As illustrated in FIG. 3, a cover sleeve 218 can be provided over the jumper tubes 220 and the fluid impermeable portions of the base pipes 205, 207 between the end rings 232, 234. Although the cover sleeve 218 can be apertured, in most instances it is solid and fluid impermeable. In certain instances, the cover sleeve 218 is not welded, adhered, held with fasteners or otherwise affixed to the well screen assemblies 202, 203, but rather is captured between the end rings 232, 234.

FIG. 3 shows a drain tube 228 is adapted to collect fluid in the wellbore, e.g., the carrier fluid of the gravel packing slurry, from fluid impermeable portions of the well screen assemblies 202, 203 and communicate the fluid to fluid permeable portions of the well screen assemblies 202, 203. The drain tube 228 includes a fluid permeable sidewall that allows fluid to enter an interior center passage of the drain tube 228, flow to another location of the tube 228 and then flow out of the tube. Thus, for example, in the context of gravel packing, the tube 228 facilitates draining the carrier fluid from the gravel packing slurry in the region over the cover sleeve 218, because the carrier fluid can enter through the sidewall the drain tube 228 at the cover sleeve 218 and be communicated uphole and/or downhole to the exterior of the screens 210, 212. At the exterior of the screens 210, 212, the carrier fluid can drain into the center bore of the string and be communicated up to the terranean surface.

Figure 4B:
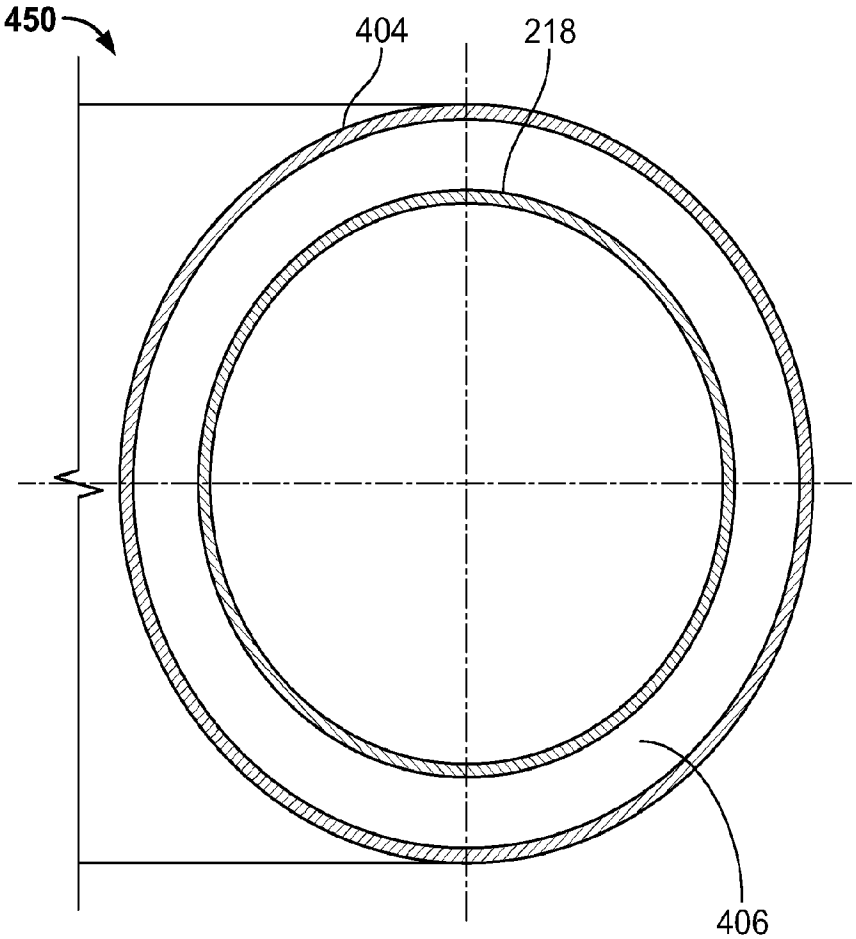
FIG. 4B is an axial cross-sectional view of another example drain tube affixed to a cover sleeve.
Figure 4A:
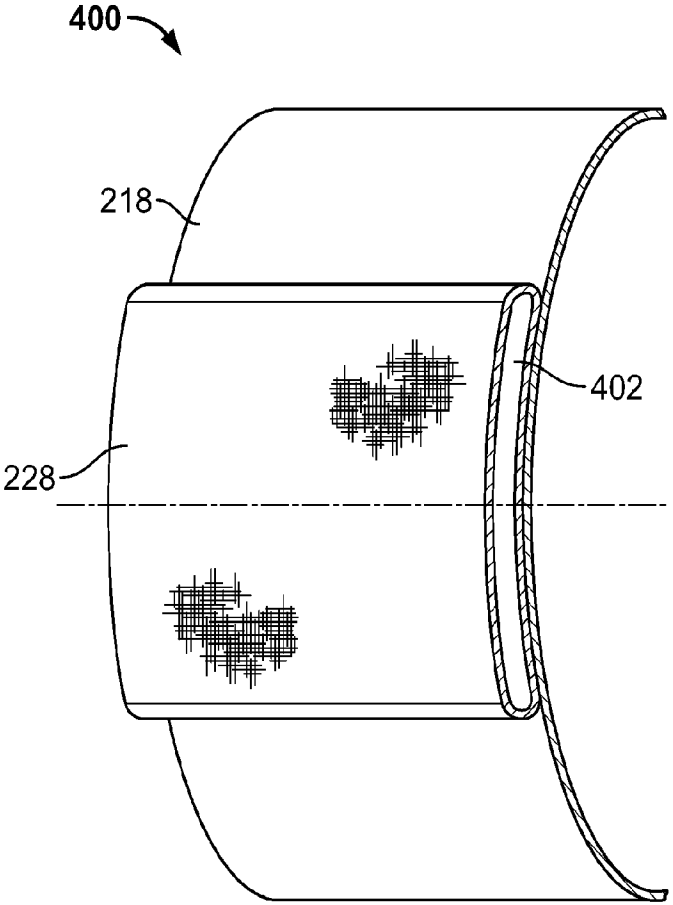
FIG. 4A is a perspective cross-sectional view of an example drain tube affixed to a cover sleeve.

FIG. 3 and FIG. 4A show a configuration of drain tube 228 that runs beside the well screen assemblies 202, 203 (i.e., the screen assemblies 202, 203 are outside of the interior center passage of the drain tube 228). Although one is shown, more than one drain tubes 228 could be provided arranged at different locations around the circumference of the well screen assemblies 202, 203. FIG. 4B shows a drain tube 404 encircling the well screen assemblies 202, 203.

In certain instances, the drain tube 228, 404 is affixed to an exterior of the cover sleeve 218. FIG. 3 shows the drain tube 228 extending the entire length of the cover sleeve 218, spanning across the impermeable end portions of the base pipes, between the screens of the well screen assemblies 202, 203. The drain tube 404 (FIG. 4B) can likewise extend the entire length of the cover sleeve 218. In certain instances, the drain tube 228 (FIG. 3) can traverse the end rings 232, 234 and have ends terminating radially over the screens (and apertured shrouds 201, 204) of the well screen assemblies 202, 203. The ends of the drain tube 228 can be open or closed. In an instance where the drain tube 228 traverses an end ring and that end ring includes a centralizer, the centralizer can be configured to protect the drain tube 228 during travel through the wellbore. If the drain tube 228 does not traverse the end ring, gravel slurry access can be proved at the centralizer or in the centralizer.

The drain tube 228 of FIG. 4A has a non-circular cross-section, specifically a greater width (in the direction of the circumference of the cover sleeve 218) than thickness that facilitates maintain a smaller outer diameter of the entire assembly. Other cross-sections, including circular, rectangular, and non-symmetric cross-sections, could be used. In certain instances, the drain tube 228 is a screen tube made of one or more layers of screen material, such as a welded or woven mesh, formed into a tube and partially flattened, retaining the internal central passage 402. The drain tube 404 of FIG. 4B can also be made of a screen material formed in a tube and placed over the cover sleeve 218, retaining the internal central (annular) passage 406. The screen material results in sidewalls of the tube 228, 404 being fluid permeable. A support structure or fluid transport layer (e.g., axial wires, large square mesh, or another configuration) can be provided in the internal central passage 402, 406 to maintain the passage open. In certain instances, the drain tube 228, 404 can be a solid tubing with apertures in the sidewalls to make the sidewalls of the tube fluid permeable. In certain instances, the entire length of the tube is fluid permeable.

Also, the screen material can have a selected industry rating for filtering particulate over a specified size or the apertures sized to filter particular over a specified size.

In use, as the string is made up at the surface, adjacent well screen assemblies are coupled end-to-end trapping the cover screen, with the drain tube affixed (welded, clamped, and/or otherwise) thereto, between them. The string is run into position in the wellbore, and gravel slurry introduced down the annulus between the string and the wellbore to fill the annuls with gravel. As the gravel is placed, the carrier liquid in the slurry is drained off through the well screen assemblies, into the center bore of the string and/or through the shunt tubes and withdrawn to the surface. Carrier fluid in regions around fluid impermeable portions of the well screen assemblies, such as near the cover sleeve and/or ends of the well screen assemblies, enters the fluid permeable sidewalls of the drain tubes and is transported up or downhole to the fluid permeable portions of the well screen assemblies. The drain tubes facilitate a more even drain of the gravel pack, and thus a more even distribution of gravel in the annulus with fewer voids.

A number of embodiments have been described. Nevertheless, it will be understood that various modifications may be made. Accordingly, other embodiments are within the scope of the following claims.

What is claimed is:

1. A well screen system for use in a wellbore, comprising:

an elongate base pipe having a fluid permeable portion;

a screen encircling the fluid permeable portion of the base pipe and configured to filter against passage of particulate into a center bore of the base pipe, the base pipe having a fluid impermeable portion exterior to the screen;

a cover sleeve located around a fluid impermeable portion of the base pipe; and a drain tube comprising a fluid permeable sidewall residing exterior to the base pipe and screen, coupled to the cover sleeve to be movable with the well screen system, the drain tube having an interior passage and a length that extends beyond the cover sleeve to communicate fluid from the fluid impermeable portion of the well screen assembly to a fluid permeable portion of the well screen system.

2. The well screen system of claim 1, where the drain tube comprises a fluid permeable portion radially over the fluid impermeable portion of the base pipe and a fluid permeable portion radially over the screen.

3. The well screen system of claim 1, where the drain tube comprises a screen material arranged as a flattened tube.

4. The well screen system of claim 1, comprising an exterior shroud encircling the screen, and where the drain tube encircles the shroud.

5. The well screen system of claim 4, comprising a shunt tube residing between the screen and the shroud.

6. The well screen system of claim 1, where the drain tube encircles the cover sleeve.

7. The well screen system of claim 1, where the drain tube resides along a side of the base pipe and the base pipe is outside of the interior center passage of the drain tube.

8. The well screen system of claim 1, where the base pipe and the screen comprise a first base pipe and a first screen of a first well screen assembly; and the well screen system further comprises a second well screen assembly coupled end-to-end with the first well screen assembly; and where the drain tube spans between the first well screen assembly and the second well screen assembly and the fluid permeable sidewall of the drain tube resides radially over the fluid impermeable base pipe of the first well screen assembly and a fluid impermeable base pipe of the second well screen assembly.

9. The well screen system of claim 8, where an end of the drain tube resides radially over the exterior of the screen of the first well screen assembly and another end of the drain tube resides radially over the exterior of a screen of the second well screen assembly.

10. The well screen system of claim 8, comprising:

a first shunt tube axially spanning the screen and residing between the first screen and an exterior shroud of the first well screen assembly;

a second shunt tube axially spanning a screen of the second well screen assembly and residing between the screen and an exterior shroud of the second well screen assembly;

a jumper tube coupled to the first and second shunt tubes and residing radially over the fluid impermeable portions of the first and second base pipes; and the cover sleeve being located over the jumper tube and the fluid impermeable portions of the first and second base pipes; and where the drain tube resides exterior to the cover sleeve.

11. The well screen system of claim 10, where the drain tube encircles the cover sleeve.

12. The well screen system of claim 10, where the drain tube resides along a side of the exterior shrouds of the first well screen assembly and the second well screen assembly, and the well screen assemblies are outside of the internal center passage of the drain tube.

13. A method, comprising:

placing a well screen assembly in a well bore, the well seen assembly comprising a base pipe having a fluid permeable portion having the well screen located thereabout, and a fluid impermeable portion covered by a cover sleeve coupled to the well screen and a tubing coupled to the cover sleeve to be movable with the well screen assembly, the tubing located exterior to the base pipe;

collecting a carrier fluid of a gravel packing slurry in a well bore annulus at a fluid impermeable portion of the well screen assembly in the tubing;

communicating the carrier fluid, via the tubing, through the gravel packing beyond the cover sleeve and to a fluid permeable portion of the well screen assembly; and communicating the carrier fluid to a location radially over a fluid permeable screen of the well screen assembly.

14. The method of claim 13 wherein the tubing comprises a fluid permeable screen and where collecting the carrier fluid comprises collecting the carrier fluid through the sidewall of the drain tubing and filtering against particulate of a specified size or larger.

15. A well system, comprising:

a well screen assembly comprising a screen portion that is fluid permeable to a center bore of the assembly and a portion that is fluid impermeable to the center bore;

a cover sleeve located around the portion that is fluid impermeable; and a conduit with fluid permeable sidewalls at the outer diameter of the screen portion and coupled to the sleeve to be movable with the well screen assembly and having a length that extends beyond the cover sleeve to communicate fluid from the fluid impermeable portion to the fluid permeable screen portion.

16. The well system of claim 15, where the conduit comprises a screen tube.

17. The well system of claim 15, where the conduit comprises a screen material encircling at least a portion of the fluid permeable screen portion and at least a portion of the fluid impermeable portion.

18. The well system of claim 15, wherein the well screen assembly is a first well screen assembly, the well system further comprising:

a second well screen assembly; and the cover sleeve spanning the screen portion of the first well screen assembly to a screen portion of the second well screen assembly, and where the conduit spans between the screen portion of the first well screen assembly and the screen portion of the second well screen assembly.

* * * * *